US005886307A

United States Patent [19]

Full et al.

[11] Patent Number: 5,886,307

[45] Date of Patent: Mar. 23, 1999

[54] SAFETY DETECTION SYSTEM FOR SLIDING DOORS

[75] Inventors: Gary G. Full; Richard D. Pustelniak, both of Tucson, Ariz.

[73] Assignee: Otis Elevator Company, Farmington, Conn.

[21] Appl. No.: 876,128

[22] Filed: Jun. 23, 1997

[51] Int. Cl.[6] ..... B66B 13/26

[52] U.S. Cl. ..... 197/317; 187/393; 49/26; 49/25

[58] Field of Search ..... 187/317, 393; 49/26, 25

[56] References Cited

U.S. PATENT DOCUMENTS

| | | | |
|---|---|---|---|
| Re. 30,719 | 8/1981 | Mills | 187/52 R |
| 3,852,592 | 12/1974 | Scoville et al. | 250/221 |
| 4,029,176 | 6/1977 | Mills | 187/52 R |
| 4,794,248 | 12/1988 | Gray | 250/221 |
| 4,851,746 | 7/1989 | Milke | 318/467 |
| 4,894,952 | 1/1990 | Trett et al. | 49/25 |
| 5,142,152 | 8/1992 | Boiucaner | 250/341 |
| 5,149,921 | 9/1992 | Picado | 187/317 |
| 5,420,430 | 5/1995 | Trett | 250/341 |
| 5,567,931 | 10/1996 | Amend et al. | 250/221 |
| 5,698,824 | 12/1997 | Platt | 187/317 |

FOREIGN PATENT DOCUMENTS

699619 A2 3/1996 European Pat. Off. .

*Primary Examiner*—Robert E. Nappi

[57] ABSTRACT

A safety system for detecting objects or persons that approach closing doors includes a plurality of detectors on one door and a plurality of transmitters on an opposite door. The plurality of transmitters emit a signal at an angle into a hallway. The intensity of the signal emitted from the transmitters is progressively reduced as the distance between the closing doors is decreasing. The reduction in intensity of the transmitted signal allows discrimination between actual targets and false targets.

5 Claims, 2 Drawing Sheets

SAFETY DETECTION SYSTEM FOR SLIDING DOORS

CROSS-REFERENCE TO RELATED APPLICATIONS

This application is related to commonly owned co-pending application filed on the same day herewith having Ser. Nos. 08/876,127 and 08/879,676

TECHNICAL FIELD

The present invention relates to door systems and, more particularly, to safety detection systems therefor.

BACKGROUND OF THE INVENTION

Many automatic sliding doors are equipped with safety systems intended to detect potential interference with the closing operation of the doors. These safety systems usually include a plurality of signal sources disposed on one door and a plurality of receivers disposed on the other door. The signal sources emit a curtain of signals across the threshold of the door to be detected by the plurality of receivers. When the signal curtain is interrupted, the safety system communicates with a door controller either to cease closing operation and open the doors or to maintain the doors open, depending on the initial position of the doors.

A doorway safety system described in U.S. Pat. No. 4,029,176 to Gerald W. Mills and entitled "Doorway Safety Device" uses acoustic wave transmitters and receivers to detect endangered objects or persons. Not only does the patented system detect objects positioned between the doors and across the threshold, but it also extends the zone of detection into the entryway. The transmitters send out a signal at an angle into the entryway. When an obstruction enters the detection zone, the signal reflects from the obstruction and is detected by the receivers.

Similarly, a published European Patent Application No. EP 0699619A2 to Memco Limited and entitled "Lift Installation for Preventing Premature Closure of the Sliding Doors" describes a three-dimensional system for detecting objects or persons not only across the threshold, but also in the entryway.

One shortcoming of the existing safety systems is detection of objects after the doors have been partially closed. As the doors are closing, the detection zone is also moving and structural obstructions, such as the walls supporting the doors or an outside set of doors, fall within the detection zone. Once the signal is intercepted by a structural obstruction, it is reflected to another structural obstruction and is subsequently detected by the receivers. As the doors are closing and the distance between the transmitters and receivers becomes progressively smaller, the signal that is reflected from the walls and other architectural obstructions travels shorter distances and still remains strong when received by the receivers. The existing safety systems are not able to discriminate between the signal that is reflected from false targets at relatively short distances between the doors and a signal reflected from a true obstruction. The strong signal overloads the receivers. Thus, as the doors close, the safety systems lose the ability to function properly. Many existing safety systems are turned off at some point during closure to avoid false target detections.

The European patent application described above attempts to solve the problem by reducing the gain of the receivers. However, the downside of reducing the gain in the receivers is that actual targets are also not detected.

DISCLOSURE OF THE INVENTION

It is an object of the present invention to improve a safety detection system for sliding doors.

It is another object of the present invention to ensure proper continuing operation of the safety detection system for sliding doors as the doors close.

According to the present invention, a safety system for detecting objects or persons approaching closing doors includes a plurality of detectors on one door and a plurality of transmitters emitting a signal on an opposite door, with the intensity of the emitted signal being reduced as the doors begin to close. The progressive reduction in the intensity of the emitted signal as the doors are closing is beneficial because the signal that reflects from the walls and other doors and is then reflected again through another architectural obstruction is no longer strong enough to be detected and registered as a target. At the same time, the signal remains sufficiently strong to be registered when it is reflected from a true target.

In the best mode embodiment of the present invention, the number of the powered transmitters is progressively reduced as the distance between the closing doors become smaller.

In an alternate embodiment of the present invention, the power to each transmitter is reduced as the distance between the closing doors becomes smaller.

In another alternate embodiment of the present invention, a combination of reduction of power to each transmitter and reduction in a number of powered transmitters is used to reduce the intensity of the transmitted signal as the distance between the closing doors becomes smaller.

The foregoing and other advantages of the present invention become more apparent in light of the following detailed description of the exemplary embodiments thereof, as illustrated in the accompanying drawings.

BEST MODE FOR CARRYING OUT THE INVENTION

Figure 1:
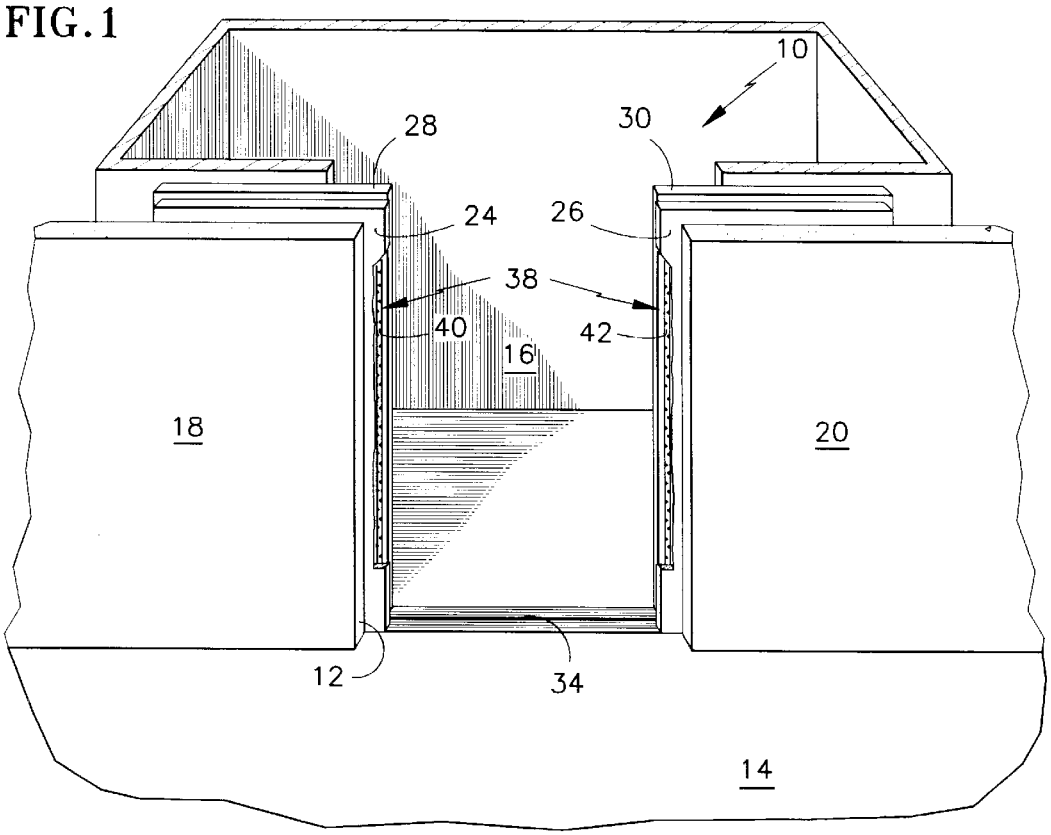
FIG. 1 is a schematic, partially cut-away, perspective view of a door system with a safety detection system mounted thereon, according to the present invention.

Referring to FIG. 1, a door system 10 for opening and closing a doorway 12 from a hallway 14 into an elevator cab 16 is adjacent to walls 18, 20 and includes a set of hallway doors 24, 26 and a set of elevator cab doors 28, 30. Both sets of doors 24, 26, 28, 30 slide open and closed in unison across a threshold 34 with the hallway set of doors 24, 26 closing and opening slightly ahead and behind of the cab doors, 28, 30 respectively.

A safety detection door system 38 is disposed on the cab doors 28, 30 adjacent to the hallway doors 24, 26. The safety door system 38 includes a transmitter stack 40 and a detector stack 42, each disposed on opposite sides of the doorway 12 and facing each other.

Figure 2:
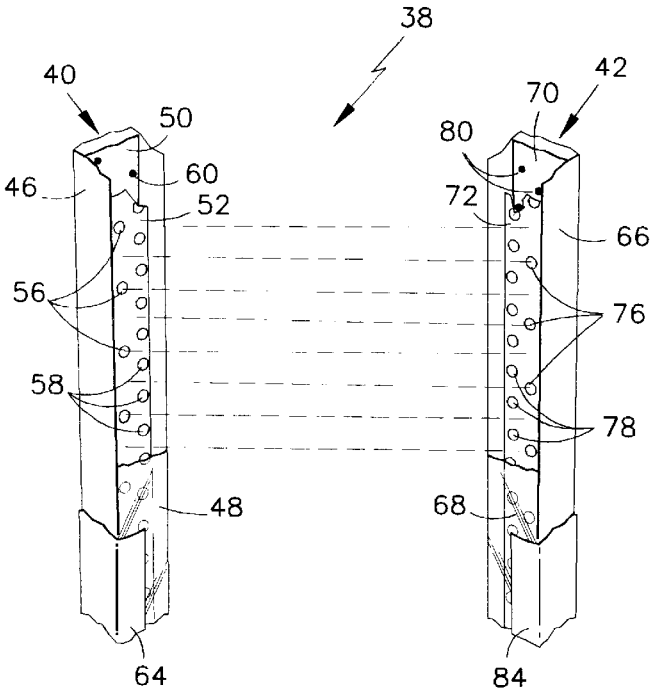
FIG. 2 is a schematic, cut-away, perspective view of a transmitter stack and a detector stack of the safety detection system of FIG. 1.

Referring to FIG. 2, each transmitter stack 40 includes a housing 46 and a transparent cover 48 for protecting a transmitter circuit board 50 and a transmitter lens board 52. The transmitter lens board 52 includes a plurality of transmitter three-dimensional lenses 56 and a plurality of transmitter curtain lenses 58. The transmitter circuit board 50 includes a plurality of transmitters or LEDs (light emitting devices) 60 disposed adjacent to each lens 56, 58 for emitting infrared light. A transmitter barrier 64 supports the housing 46 and partially blocks light for the transmitter three-dimensional lenses 56.

The detector stack 42 is structured as a mirror image of the transmitter stack 40. The detector stack 42 includes a detector stack housing 66 with a transparent detector stack cover 68 for protecting a detector circuit board 70 and a detector lens board 72. The detector lens board 72 includes a plurality of detector three-dimensional lenses 76 and a plurality of detector curtain lenses 78. The detector curtain lenses 78 are disposed directly across from the transmitter curtain lenses 58. The detector three-dimensional lenses 76 are vertically staggered from the transmitter three-dimensional lenses 56. The detector circuit board 70 includes a plurality of detectors or photodiodes 80 adjacent to each lens 76, 78 for detecting reflected light. A detector barrier 84 supports the detector housing 66 and partially blocks light for the detector three-dimensional lenses 76.

The safety system 38 also includes a controller box (not shown) that provides and controls power to the stacks 40, 42, sequences and controls the signal to the stacks 40, 42, and communicates with a door controller (not shown).

In operation, the safety system 38 prevents the cab doors 28, 30 from closing if an object or person is detected either across the threshold 34 or approaching the doorway 12. The transmitter curtain lenses 58 emit a signal across the threshold 34 to the detector curtain lenses 78. If the curtain signal is interrupted when the doors 28, 30 are either open or closing, the safety system 38 communicates to the door controller (not shown) to either maintain the doors open or reverse the closing operation, respectively. The strength of the curtain signal received at the detector curtain lenses 78 is utilized to determine the distance between the closing doors 28, 30.

Figure 3:
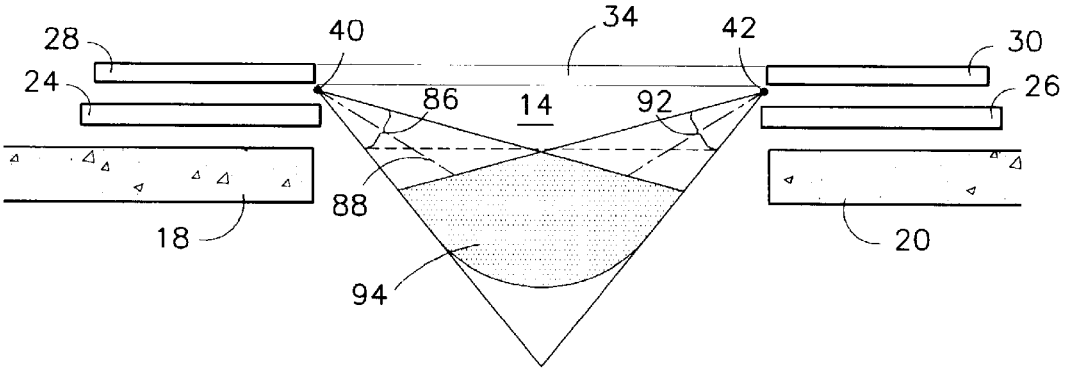
FIG. 3 is a schematic, plan view of the door system with the safety system of FIG. 1 with the fully opened doors.
Figure 4:
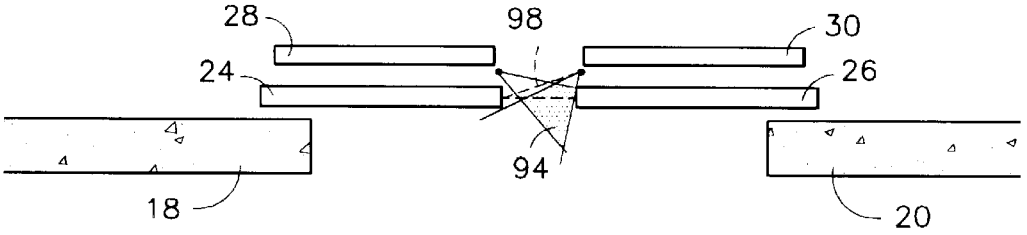
FIG. 4 is a schematic plan view of the door system with the safety system of FIG. 1 with the doors partially closed.

The transmitter three-dimensional lenses 56 emit a three-dimensional signal at a predetermined angle outward into the hallway 14, as shown in FIGS. 3 and 4. In the best mode of the present invention, the transmitter three-dimensional lenses 56 have a relatively narrow field of view 86 spanning approximately ten degrees (10°) and having a centerline 88 at approximately thirty degrees (30°) angle from the threshold 34 into the hallway 14.

The detectors 80 and detector three-dimensional lenses 76 receive a signal emitted from the transmitter three-dimensional lenses 56 and reflected from an object at a predetermined angle. In the best mode of the present invention, the detector three-dimensional lenses 76 have a relatively broader field of view 92, limited by the physical constraints of the detector stack housing 66 and the detector barrier 84.

The intersection between the field of view 86 of the transmitter three-dimensional lenses 56 and the field of view 92 of the detector three-dimensional lenses 76 defines a detection zone 94. When an object or person enters the detection zone 94, the signal from the transmitter three-dimensional lenses 56 hits the obstruction positioned within the detection zone 94 and is reflected into the detector three-dimensional lenses 76. When the detector three-dimensional lenses 76 receive a signal, the safety system 38 communicates with the door controller to either reverse the closing operation or maintain the doors 28, 30 open.

To avoid power drain, the three-dimensional transmitters 80 are powered in groups. In the best mode of the present invention, when the doors 28, 30 are opened, the three-dimensional transmitters 80 are powered in groups of three. Thus, the first group of three three-dimensional transmitters 80 is powered for a preset period of time, then the second group of three three-dimensional transmitters is powered for the preset period of time while the first group of the three three-dimensional transmitters is powered down. Subsequently, a third group of three three-dimensional transmitters is powered while the first and second groups are powered down, and so forth. The preset time for powering each group in the best mode of the present invention ranges approximately from 500 to 1000 microseconds. Thus, the circuitry sequentially powers each group of three-dimensional transmitters.

As the doors 24, 26, 28, 30 begin to close and the distance between the transmitter three-dimensional lenses 56 and detector three-dimensional lenses 76 reduces, the three-dimensional transmitters are powered in groups of two three-dimensional transmitters per group. At even smaller distances between the closing doors, the number of three-dimensional transmitters is reduced to one.

Reduction in the intensity of the transmitter signal, as the distance between the transmitter stack 40 and detector stack 42 becomes smaller, improves both the reliability and the effectiveness of the safety system 38. The progressive reduction in the intensity of the emitted signal as the doors 28, 30 are closing is beneficial because the signal that is reflected from the walls 18, 20 and other doors 24, 26 and then reflected through another architectural obstruction is no longer strong enough to be detected and registered as a target. At the same time, the signal remains sufficiently strong to be registered when it is reflected from a true target. A path of the signal for the false target is best seen in FIG. 4 and is shown by the dash line 98.

In an alternate embodiment of the present invention, the number of three-dimensional transmitters 80 in each group remains the same throughout the closing operation of the doors, but the intensity of the signal is reduced as a function of the distance between the closing doors 28, 30. The smaller the distance between the closing doors and the transmitter and detector stacks, the lower the intensity of the signal. The reduction of power to each three-dimensional transmitter takes place in the safety system controller. The distance between the closing doors can be determined as a function of the strength of the curtain signal.

In another alternate embodiment of the present invention, the combination of a reduction in the number of powered three-dimensional transmitters and a reduction in power of the signal in each three-dimensional transmitter is used to reduce the intensity of the signal emitted from the transmitter.

Although the best mode of the present invention describes double sliding elevator doors, the present invention is also applicable to single sliding doors, vertical sliding doors and other similar door systems. In a single sliding door configuration, one of the stacks can be mounted on the door, whereas the second stack can be mounted on the wall across the doorway. In a vertical door configuration, frequently used in freight elevators, stacks can be mounted horizontally.

While the present invention has been illustrated and described with respect to a particular embodiment thereof, it should be appreciated by those of ordinary skill in the art, that various modifications to this invention may be made without departing from the spirit and scope of the present invention. For example, the best mode of the present invention shows and describes a staggered pattern for the transmitter three-dimensional lenses and the detector three-dimensional lenses. However, for the purposes of the present invention, any pattern of the three-dimensional lenses is suitable. Furthermore, other energy sources can be used as transmitters.

We claim:

1. A safety system for detecting an obstruction in a hallway, said obstruction being disposed in front of a set of sliding doors, said safety system comprising:

a plurality of transmitters emitting a signal into said hallway at a preset range of angles; and a plurality of detectors for receiving said signal that reflects from said obstruction;

wherein a number of said plurality of transmitters powered at a particular instance is lowered as said doors are closing, whereby the intensity of said emitted signal is progressively reduced as said doors begin to close thereby to reduce secondary reflections.

2. The safety system according to claim 1 wherein power to said plurality of transmitters is lowered as said doors are closing.

3. The safety system according to claim 1 wherein power to each of said plurality of transmitters powered at a particular instance is decreased as said doors are closing.

4. The safety system according to claim 1 wherein said plurality of transmitters is powered sequentially in subsets of individual transmitters.

5. The safety system according to claim 4 wherein a number of said individual transmitters in said subset is reduced as said doors are closing.

* * * * *